United States Patent [19]

Imbert

[11] 4,135,311

[45] Jan. 23, 1979

[54] DEVICE FOR DRYING WRAPPED ROD-SHAPED PRODUCTS, IN PARTICULAR CIGARS

[75] Inventor: Pierre L. Imbert, Fleury-les-Aubrais, France

[73] Assignee: Service d'Exploitation Industrielle des Tabacs et des Allumettes, Paris, France

[21] Appl. No.: 836,059

[22] Filed: Sep. 23, 1977

Related U.S. Application Data

[63] Continuation of Ser. No. 504,331, Sep. 9, 1974, abandoned, which is a continuation-in-part of Ser. No. 373,194, Jun. 25, 1973, abandoned, which is a continuation of Ser. No. 134,326, Apr. 15, 1971, abandoned.

[30] Foreign Application Priority Data

Apr. 16, 1970 [FR] France ..... 70.13764

[51] Int. Cl.[2] ..... F26B 17/00

[52] U.S. Cl. ..... 34/57 E; 34/104; 34/107; 34/156; 131/136

[58] Field of Search ..... 34/57 A, 57 E, 57 R, 34/104, 105, 106, 10, 107, 156; 131/135, 136; 302/31; 308/9

[56] References Cited

U.S. PATENT DOCUMENTS 3,434,311 3/1969 Dawson ..... 68/20

*Primary Examiner*—John J. Camby
*Assistant Examiner*—Larry I. Schwartz
*Attorney, Agent, or Firm*—Jacobs & Jacobs

[57] ABSTRACT

Process for drying products wrapped in a humid envelope, and, in particular, rod-shaped products wrapped in at least one tobacco envelope, which consists in bringing into contact with the product, air whose relative humidity is lower than that of the surrounding air, comprising the step of circulating said air at high speed, which is renewed in a continuous manner, in a zone closely surrounding at least part of the product envelope.

3 Claims, 3 Drawing Figures

DEVICE FOR DRYING WRAPPED ROD-SHAPED PRODUCTS, IN PARTICULAR CIGARS

CROSS REFERENCE

Figure 1:
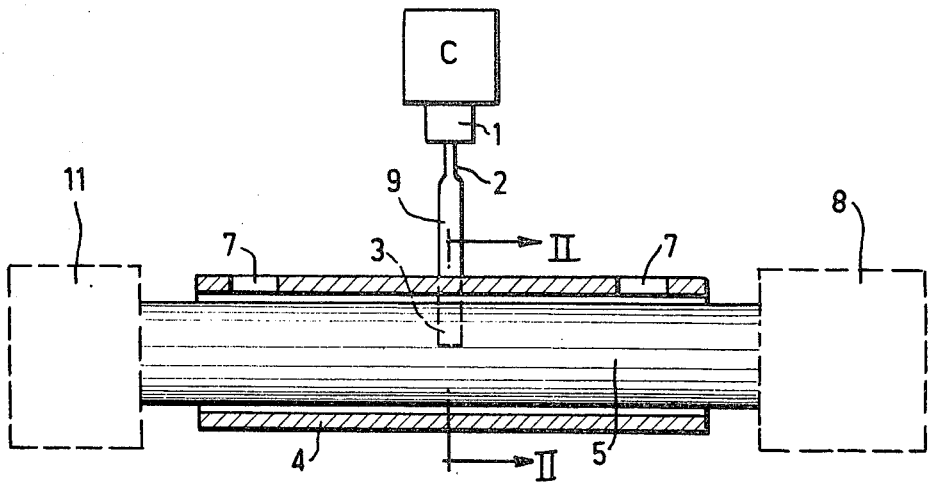

This is a continuation of Ser. No. 504,331 filed Sept. 9, 1974 now abandoned which is a continuation-in-part of Ser. No. 373,194, filed June 25, 1973, now abandoned, which in turn is a continuation of my application Ser. No. 134,326, filed Apr. 15, 1971, now abandoned.

The invention relates to a device for rapidly drying products wrapped in a humid envelope and, in particular, for drying rod-shaped products designed for smoking, wrapped in at least one tobacco envelope.

An object of the invention is to provide a device in which air, with a lower relative humidity than that of the surrounding air, is brought into contact with the product, said air being circulated at high speed, and renewed in a continuous manner, in a zone closely surrounding the product over at least a part of the latter.

The air circulation zone closely surrounding the product can communicate with the external atmosphere into which the air having circulated around the product diffuses or with the dry and cold air source towards which this air returns after circulating around the product. Since production of dry and cold air obtained by compression is involved, the product is placed in an area in which the air, blown at a high speed, has expanded to a maximum so that its relative humidity is as low as possible. Thus, the drying zone is set out such that the blown air is, in this zone, at a pressure barely higher than atmospheric pressure.

According to the invention, the device for rapidly drying a humid envelope in which a rod-shaped tobacco product is enclosed without substantial drying of said product, comprises:

(a) means operable to provide a source of air having a relative humidity lower than the air previously surrounding the envelope to be dried;

(b) an annular drying chamber having at least one constricted portion with an inside section slightly greater than the outside section of said envelope and its enclosed product;

(c) means for rapidly conveying the envelope and its enclosed product coaxially through said chamber; and (d) means for drying said product, including at least one air inlet in said chamber communicating with said air source, means for circulating air from said air source through said chamber in the zone defined by the outside surface of said envelope and the inside of said drying chamber, and at least one air outlet in said chamber operable to permit escape of said circulating air after passage through said zone, said air circulating means and said constricted portion being operable cooperatively to support and center the product by a cushion of air between said product and said constricted portion of said chamber.

In said device, the rod product may pass coaxially through the chamber without any conveying means located in the chamber, the product being supported by an air cushion which provides a centering of the rod in the chamber and therefore a perfectly uniform drying all around the envelope of the product.

Figure 2:
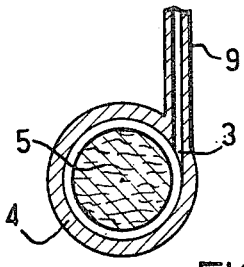
Figure 3:
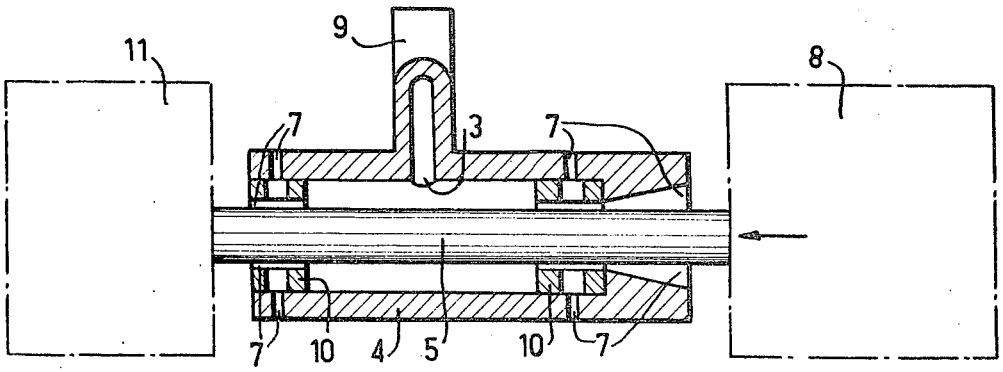

A good understanding of the invention may be had by reference to the accompanying drawings in which:

FIG. 1 is a front elevation in axial cross-section of the device according to the invention, FIG. 2 is a section along line II—II of FIG. 1, and FIG. 3 is a view similar to FIG. 1 of a second embodiment.

The device of the invention shown in FIGS. 1 and 2 comprises a cylindrical chamber 4 located on the path of a continuous rod-shaped tobacco product 5 delivered by a making-machine 8. The continuous rod is thus fed by said machine 8 through chamber 4 to, for example, a cutter 11. The inside diameter of said chamber 4 is slightly greater than that of the product 5. Into said chamber 4 there opens the nozzle end 3 of a tube 9 connected to a compressor C through a distribution network 1 and a reducing valve 2.

The pressure of the compressor used is 7 bars and the speed of the blown air is of the order of 7 meters per second. High speed air circulates in the annular zone surrounding the product and escapes rapidly, in particular, through openings 7 where it drops to atmospheric pressure.

As can be seen in FIG. 2, the compressed air tangentially enters the annular zone between the rod 5 and the chamber 4, flows around the product and circulates over the surface of the product to dry the envelope, providing a good centering of said product, as well as a perfect and uniform drying of the envelope, before escaping through the outlet openings 7.

In the embodiment of FIG. 3, the chamber 4 comprises two constricted portions 10, 10', each having a diameter slightly greater than the diameter of the rod 5. The outlets 7 open into said portions 10, 10' and the air coming out of nozzle 3 tangentially enters the chamber 4 and flows around the outer surface of the rod in said portions 10, 10', thereby providing a good centering and a uniform drying as in the embodiment of FIG. 1.

What we claim is:

1. A device for rapidly drying a humid envelope, in which a rod-shaped tobacco product is enclosed without substantial drying of said product, said device comprising (a) means operable to provide a source of air having a relative humidity lower than the air previously surrounding the envelope to be dried;

(b) an annular drying chamber having at least one constricted portion with an inside section slightly greater than the outside section of said envelope and its enclosed product;

(c) means for rapidly conveying the envelope and its enclosed product coaxially through said chamber; and (d) means for drying said product, including at least one air inlet disposed in the median portion of said chamber communicating with said air source and operable to admit air tangentially into said chamber from said air inlet for direct circulation about the outside surface of said envelope in said drying chamber, and at least one air outlet disposed at one end portion of said chamber and operable to permit escape of said circulating air after passage through the zone defined by the outside surface of said envelope and the inside of said drying chamber, said circulating air and said constricted portion being operable cooperatively to support and center the product by a cushion of air between said product and said constricted portion of said chamber.

2. The device according to claim 1, wherein the chamber has, along the entire path of travel of said envelope and its enclosed product therethrough, an inside section slightly greater than the outside section of said envelope and its enclosed product.

3. The device according to claim 1 wherein said annular drying chamber has a constricted portion at each end of said chamber.

* * * * *